United States Patent [19]

Hefty

[11] Patent Number: 4,662,009

[45] Date of Patent: May 5, 1987

[54] ACTUATING APPARATUS IN A LAVATORY SEAT COVERING SYSTEM

[75] Inventor: Bela Hefty, Castagnola, Switzerland

[73] Assignee: Chronomarine AG, Switzerland

[21] Appl. No.: 784,508

[22] Filed: Oct. 4, 1985

[30] Foreign Application Priority Data

Oct. 12, 1984 [CH] Switzerland ..... 4905/84

[51] Int. Cl.[4] ..... A47K 13/14; A47K 13/22; A47K 13/20

[52] U.S. Cl. ..... 4/247; 4/242

[58] Field of Search ..... 4/247, 661, 242, 243, 4/245, 246, 244; 242/55.55

[56] References Cited

U.S. PATENT DOCUMENTS

| | | | |
|---|---|---|---|
| 1,237,548 | 8/1917 | Palmer | 4/247 |
| 1,589,429 | 6/1926 | Rouse | 4/247 |
| 1,858,794 | 5/1932 | Vallecchi | 4/247 |
| 2,189,562 | 2/1940 | Doerr | 4/247 X |
| 2,243,134 | 5/1941 | Stiller | 4/247 |
| 4,106,135 | 8/1978 | Mannheim | 4/247 |
| 4,213,212 | 7/1980 | Hefty et al. | 4/247 |

FOREIGN PATENT DOCUMENTS

| | | | |
|---|---|---|---|
| 532094 | 1/1922 | France | 4/247 |
| 87682 | 10/1936 | Sweden | 4/247 |
| 448820 | 6/1936 | United Kingdom | 4/247 |

*Primary Examiner*—Henry K. Artis

*Attorney, Agent, or Firm*—Diller, Ramik & Wight

[57] ABSTRACT

In order to test the operatability of the section which dispenses a hose-shaped foil from a foil storage, which hose-shaped foil is advancable by one seat length after each use of the lavatory by means of a drive and a spent foil take-up means a check is made prior to every advancing operation if foil is still present in the foil storage. A detecting system checks if the hose-shaped foil moves, whereby simultaneously the current for the operation is checked. If such is the case a control signal is generated which indicates the operatability of the said end can be used, for instance, for deblocking access to the lavatory.

23 Claims, 9 Drawing Figures

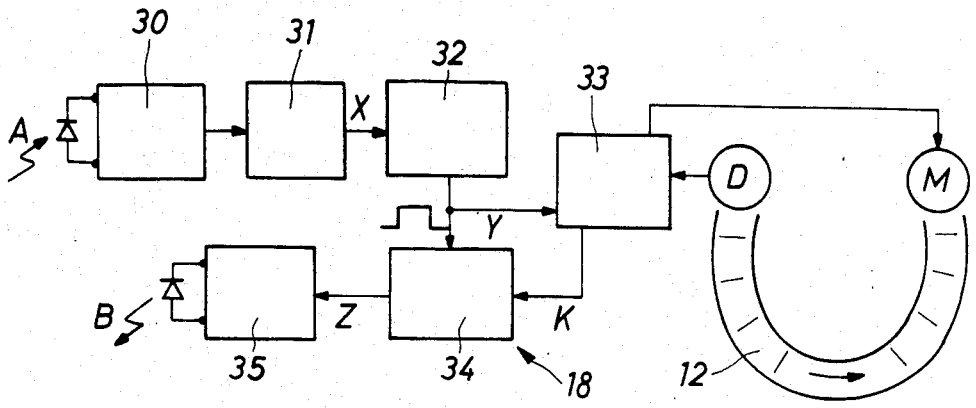
Fig.3
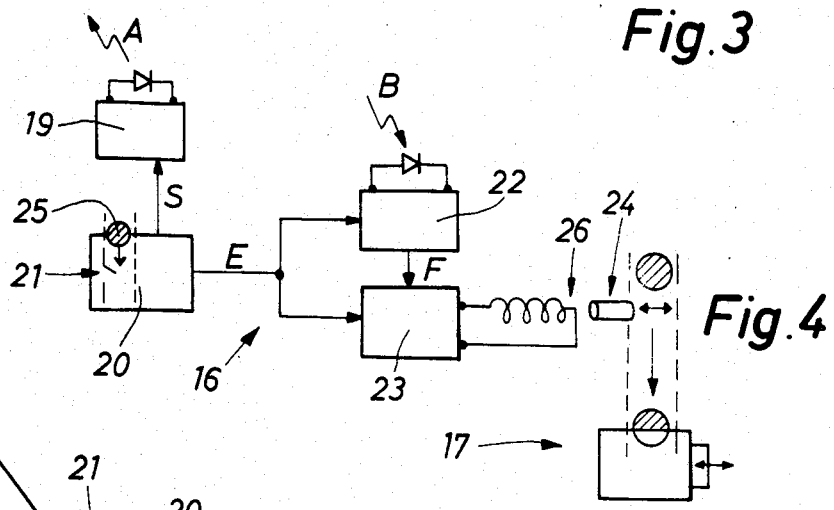
Fig.4
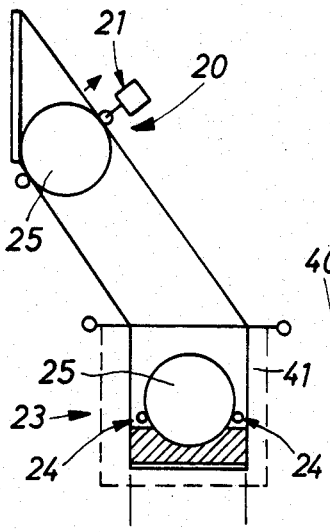
Fig.6b
Fig.5
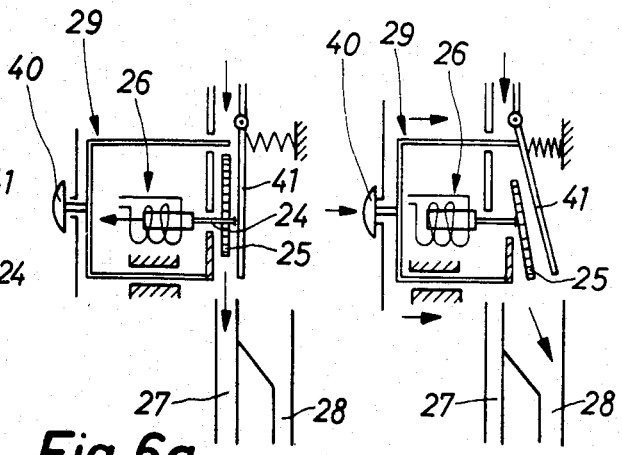
Fig.6a

ACTUATING APPARATUS IN A LAVATORY SEAT COVERING SYSTEM

BACKGROUND OF THE INVENTION

1. FIELD OF THE INVENTION

The present invention relates to an improved actuating apparatus in a means for applying a covering structure in form of a hose-shaped foil onto a lavatory seat, which applying means includes a means for storing the hose-shaped foil, a controlled means for advancing the hose-shaped foil along the lavatory seat and a means for taking up a respective spent foil section, which hose-shaped foil is arranged to be drawn off at the one end from the means for storing the hose-shaped foil by a length corresponding to the length of the lavatory seat, is arranged further to be advanced by the controlled means for advancing the foil along the lavatory seat and finally to be taken up at its other end in said spent foil take-up means.

2. DESCRIPTION OF THE PRIOR ART

Means for applying a covering structure in form of a hose-shaped foil onto a lavatory seat are generally available and disclosed, for instance, in the two Swiss patent specifications Nos. 624 004 and 624 565. In utilizing such foil applying means specifically in public or semi-public lavatories it has been found that a malfunctioning which may be due to a depleted foil storage, a breakdown of the advancing system or a damage to the hose-shaped foil may go unnoticed for an extended duration and, therefore, the hygienic effect of such apparatuses is a rather questionable matter. This poses specifically a problem in such cases, in which the advancing operation of the hose-shaped foil is triggered by an insertion of a coin because in such case a user cannot consume the expected service.

SUMMARY OF THE INVENTION

It is, therefore, an object of the invention to show measures which are applicable to a means for applying a hose-shaped foil onto a lavatory seat which allow an immediate detection of a malfunction or an exhausted storage and trigger the corresponding consequences such as, for instance, a blocking of the access to the lavatory in question, a return of the inserted coin, an announcing of the malfunction for the main- tenance.

A further object is to provide an improved actuating apparatus, of which the improvement comprises a drive control system operative to supervise and check an anewed covering of the lavatory seat by the hose-shaped foil upon each triggering of an advancing motion of the foil and to generate a control signal in accordance with the result of the supervision and check.

Preferably, mentioned drive control system is connected to a detecting system which for carrying out the drive control is responsive to an advancing movement of the hose-shaped foil at the area of the foil storage means upon each triggering of the advancing movement of the foil such to generate a control signal upon a detection of a foil advancing movement, by means of which simultaneously the presence of the hose-shaped foil at the foil storage means, the presence of the electric current needed for the overall operation as well as the proper condition of the drive and the hose-shaped foil, respectively, between drive and foil storage can be supervised or checked, respectively.

If an advancing motion of the foil is triggered via the operation of a coin receiving apparatus in accordance with one preferred embodiment, such coin receiving apparatus is preferably connected to the drive control or detecting system, respectively, for an exchange of signals and arranged such that in case of a non-receiving of a signal from the detecting system, the coin is returnable out of the coin receiving apparatus.

A further preferred embodiment is the combination of such an improved actuating apparatus with a lavatory having a lockable access of which the door lock cooperates with such coin receiving apparatus and in such case the door lock is deblockable by the coin not earlier than after having received the releasing signal from the detecting system. This allows a preventing of using the lavatory in case of a malfunction, in which case the coin can be received back via a coin return section.

BRIEF DESCRIPTION OF THE DRAWINGS

The present invention will be more fully understood by reference to the following detailed description thereof, when read in conjunction with the attached drawings, and wherein:

FIG. 3 discloses a block diagram of the parts of the circuit arranged at the lavatory of a specific embodiment including a coin operated system;

FIG. 4 illustrates a block diagram of the circuit parts of the embodiment of FIG. 3 arranged at the access door of the lavatory;

FIG. 5 illustrates a top view of a part of the coin channel located at the access door;

FIGS. 6*a* and *b* illustrate corresponding schematic sectional views in case of a presence or missing, respectively, of the releasing signal;

DESCRIPTION OF THE PREFERRED EMBODIMENTS

Figure 1:
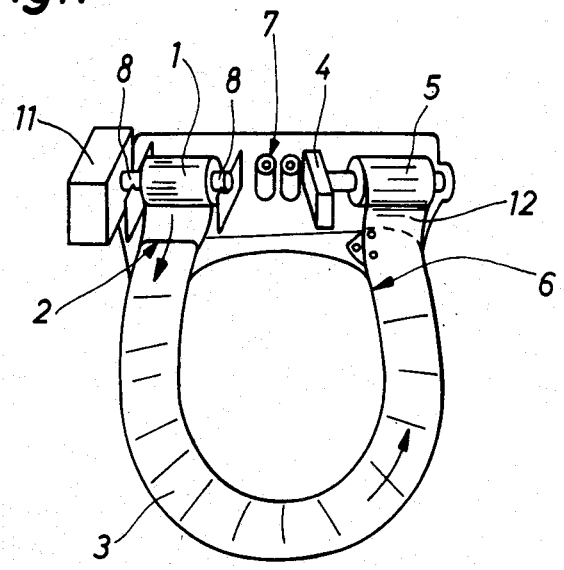
FIG. 1 discloses schematically and perspectively the basic design of a means for applying a hose-shaped foil onto a lavatory seat.
Figure 2:
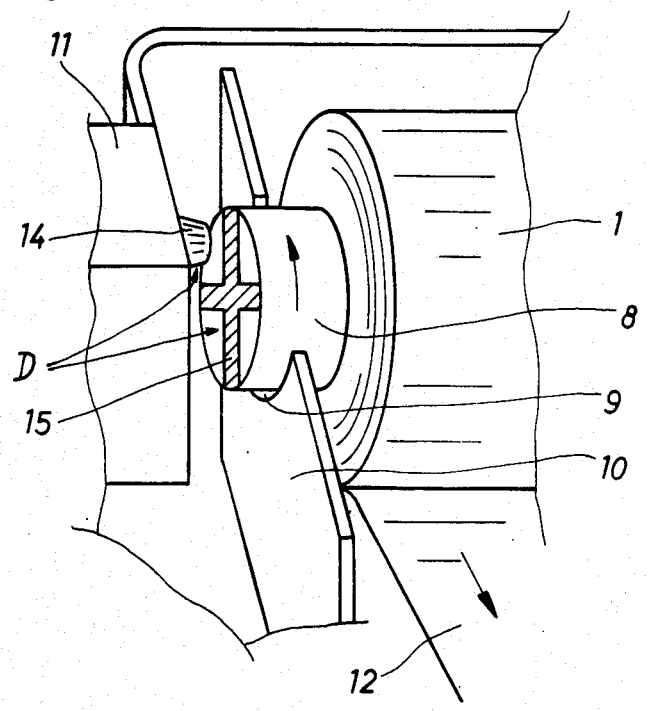
FIG. 2 discloses on a somewhat enlarged scale a detail of FIG. 1 including a detecting system.

FIGS. 1 and 2 disclose the basic arrangement and location of a preferred embodiment of the invention in which, for sake of clarity, the lavatory seat cover is omitted. The unused part of a hose-shaped lavatory seat covering foil is stored on a dispenser roll 1 serving as foil storage means, on which dispenser roll the hose-shaped foil 12 is in a wound condition and from which this foil hose is drawn onto the open end 2 of a lavatory seat 3. A take-up roll 5 serving as spent foil take-up means and driven by a motor 4 is located at the other end of said lavatory seat 3 and the spent foil hose length is rolled onto the take-up roll 5 after being severed open at 6. Because the lavatory seat 3 is structured as an exchangeable unit, the motor 4 is provided with a battery storage indicated at 7, which battery storage is, however, not mandatory. The dispenser roll 1 is provided with two lateral stubs 8, by means of which the dispenser roll 1 is supported for rotation in correspondingly shaped bearing recesses 9 of two supporting members 10 (FIG. 2) and, therefore, may be exchanged easily. A casing 11 is located aside and adjacent of mentioned dispenser roll 1, in which casing 11 a drive control system as well as a detecting system are located, which systems will be described further below.

The general operation of the actuating apparatus is that prior to every advancing movement of the hose-shaped foil 12 by a length corresponding to the length of the seat, it is determined if foil is still stored in the foil storage means. Should this be negative, the corresponding consequences may be taken, such as return of the coin or coins, respectively, a blocking of the access to the lavatory and announcing at the maintenance crew etc. Such a supervision or testing, respectively, can proceed basically by various methods. Preferably such test is carried out, in that the drive for advancing the foil is operated and thereafter ascertained if the foil moves in the general area of the foil storage, which may specifically be ascertainable by checking the rotation of the foil dispenser roll. By such procedure the presence of foil in the foil storage can be secured and, further, that the drive or hose-shaped foil, respectively, are in an uninjured or undamaged, respectively, condition at the accessible area of the lavatory seat.

Accordingly, prior to any advancing of the hose-shaped foil 12 by a length corresponding to the length of the seat, an operational test advancing motion of the foil by a small length is triggered, corresponding about to a quarter of a full rotation of the dispenser roll. By means of the detecting system a check is made at the general area of the dispenser roll 1 to determine if the dispenser roll 1 rotates or does not rotate during operation of the motor. If the dispenser roll 1 does not rotate, it is an indication of a malfunction, this may be due to the fact, that the motor 4 has not initiated an advancing movement due to a defect thereof or lack of electrical current flow for the operation thereof, it may be that the hose-shaped foil 12 has been severed at an arbitrary location after the dispenser roll 1 or, finally, it may be that the stored foil on the dispenser roll 1 has been used up. In all such cases a releasing signal from the detecting system will not be present leading to corresponding consequences which will be discussed further below.

The detecting system D can be provided preferably with an inductive receiver 14 which is located laterally at the stub 8 of the dispenser roll 1 eccentrically relative to its axis. Thereby, the stub 8 is provided with a lateral cap in which a metal deposit 15 is located, which metal deposit 15 is shaped such, that during a rotating of the dispenser roll 1, sequentially metallic and other areas of the cap reach the working area of the receiver 14. The signals generated thereby in mentioned inductive receiver 14 will be handled further in the detection means D for the generation of a releasing or go-ahead, respectively, signal.

In place of the preferred inductive receiver it is possible to use together with a corresponding different execution of the dispenser roll other receivers, such as electronically operating receivers including, for instance, capacitively or optoelectrically operating receivers or then to use mechanical switches which detect the rotation of the roll.

If the detection system determines an operational test advancement motion of the hose-shaped foil, such is followed by a further advancing motion of the foil 12 by a length corresponding to the remaining length of the seat such that finally at the end of the operation the hose-shaped foil has been exchanged along the length of the seat.

Referring now to FIGS. 3 to 6 a specific preferred embodiment of the apparatus will be described, whereby the lavatory is located within a toilet having a lockable access including a door having a door lock which is deblockable by insertion of a coin. Simultaneously with the insertion of a coin the hose-shaped foil 12 shall be advanced by a length of the lavatory seat in accordance with the above described procedure. FIG. 4 discloses the part of the switch mechanism 16 located at the door, which switch mechanism 16 cooperates with the mechanical lock 17 and FIG. 3 illustrates the part of the switch mechanism 18 located at the lavatory side and consisting of a detecting system and a motor control. Below, these parts of the circuit will be now described more in detail in accordance with their operational procedure, whereby also reference is made to FIGS. 5 and 6.

If a user inserts the requisite coin 25 in the coin control apparatus 20 (FIGS. 4, 5), the switch mechanism part located at the door is switched on by means of a micro-switch 21. The control apparatus emits thereafter a signal S for initiating operation of an infrared emitter 19, which emits an IR-signal A which is modulated with e.g. 3 kHz. At the same time a switch on signal E is generated, by means of which the energy supply is switched to an IR-receiver 22 and to a coin release apparatus 23. Thereafter, the coin 25 falls through a coin channel down to the coin release apparatus 23 (FIG. 5) and is held there by means of two holding pins 24 in a standby position. In the meantime, a IR-receiver 30 located at the part of the switch mechanism 18 located at the lavatory has received the signal A. This receiver 30 is designed as CMOS-structure and operates at minimal output in the so-called standby operation. The reason thereto is that it is the only structural part which must be permanently in operation. A switch on member 31 switches upon receipt of a signal of the receiver the battery current X onto a timer 32, which accordingly begins to operate and generates a time signal Y having a predetermined duration. This time signal Y is fed on the one hand to a control circuit 33, which switches the motor M on, which enables the operational test advancing of the foil and receives the receipt impulses K from the detecting system D and forwards these signals to a receipt timer 34. The latter operates to ascertain, that the receipt impulses are returned via an IR-emitter 35 in form of IR-releasing signal B to the switch mechanism part at the door after expiration of a certain time span of the time signal Y. The reason thereto is that during the operational test advancing motion and specifically during the start up the motor M leads to a decrease of the output of the battery due to the large consumption of energy such that a correct operation of the control would be detrimentally influenced. Accordingly, the function of the time signal Y is to allow an emitting of the receipt impulses K not earlier than after the attenuation of the start up current.

The releasing signal B of the part of the switch 18 allocated to the door is, accordingly, emitted only when the advancing has been detected by the detection system D. This releasing signal B is received by the switch part 16 located at the door via the IR-receiver 22, which has been switched on previously and which emits an actuating signal F to the coin release apparatus 23, in which apparatus the holding pins 24 are pulled back by means of a solenoid 26 such that accordingly the coin 25 moves to a corresponding channel 27 and arrives in the lock 17 and deblocks this lock, i.e. permits access to the toilet. In the meantime the advancing of the hose-shaped foil by the balance of the length of the seat is carried out at the lavatory. After operation all described parts of the circuit are switched out with the exception of the IR-receiver 30 at the lavatory.

If the releasing signal B is absent, such signifies that the detecting system has not detected an advancing motion of the hose-shaped foil 12. The coin release apparatus 23 located in the switch part 16 allocated to the door does not receive the actuating signal F such that the holding pin 24 will not be pulled back. Conclusively, the coin 25 remains in the standby position and does not deblock the lock 17.

In such case the user can retrieve the coin 25 by operating a coin return device. By pushing a corresponding button 40, the coin 25 is moved laterally towards a return channel 28 (FIG. 6), whereby the coin will remain initially clamped by a spring elastically yielding cover 41 and after it has been pushed open by a rod 29, the coin is released into mentioned channel 28.

Figure 7:
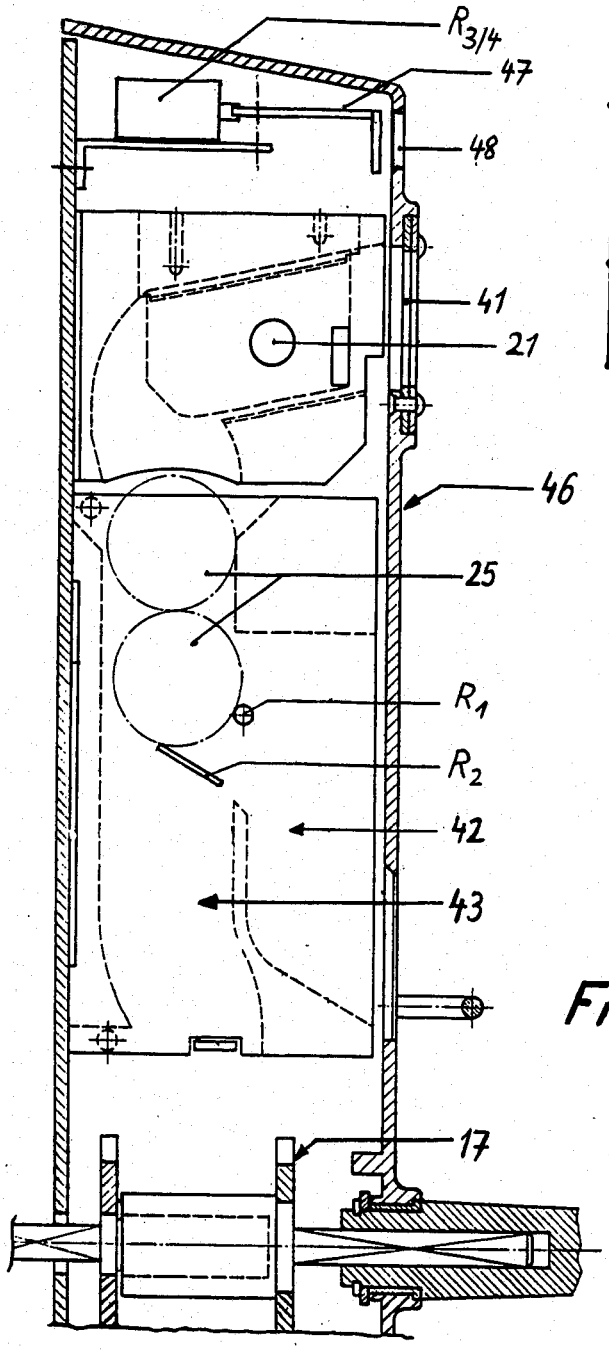
FIG. 7 illustrates a view corresponding to such of FIG. 6 of a modification including an automatic coin return system.
Figure 8:
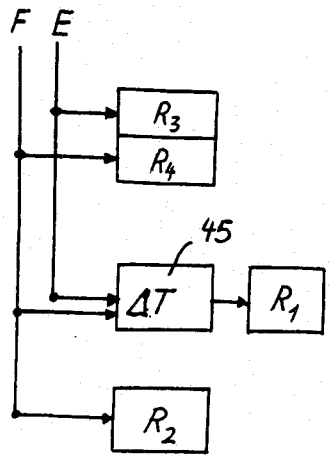
FIG. 8 illustrates a modified control circuit to the control circuit of FIG. 7.

FIGS. 7 and 8 illustrate a modification of the system described, which modification includes an automatic coin return combined with a fault announcing, which modification is illustrated schematically only. FIG. 7 illustrates a part of the switch mechanism at the door. A coin drop 41 for coins 25 is provided in a casing 46. A coin channel follows the coin drop 41 and is separated at its lower section into a coin return channel 42 and a lock channel 43. At this fork cams $R_1$ and $R_2$ project into the channel, which cams can be moved reciprocally and are operated by means of corresponding solenoids $R_1$ and $R_2$. Cam or solenoid $R_1$, respectively, liberates the coin return channel 42 and cam or solenoid $R_2$, respectively, liberates the lock channel 43, through which the coin 25 moves into the lock 17 and deblocks this lock. A fault indicator 47 is located at the upper section of the casing 46, which fault indicator 47 is operated by two solenoids $R_3$ and $R_4$ and is viewable from the outside via a window 48.

The operation of this modification will now be explained based on FIGS. 7 and 8, whereby the signals E and F correspond in function to the signals E and F mentioned above. The circuit illustrated in FIG. 8 replaces thereby substantially the units 23, 24 and 26 illustrated in FIG. 4 and the other parts of the structure of the circuit remain the same.

If a suitable coin is inserted into the coin drop 41 and enters the coin channel, such coin passes initially switch 21, which in this embodiment is an inductive receiver. In a manner already explained this triggers among other things the switch on signal E. This signal is forwarded to the solenoid $R_1$ and causes this solenoid to move the corresponding cams such that they are inserted in the coin channel. The cam of the solenoid $R_2$ is in its rest position already in the position projecting into the coin channel such that the coin is held back such as illustrated in FIG. 7. In this position of the coin the checking thereof can be carried out according to known measures. By means of the switch on signal E the solenoid $R_3$ of the fault announcing is operated, too, such that a red marking is viewable in the announcing window 48.

If the clear signal B is received from the part of the switch system 18 located at the lavatory, the operating signal F is triggered in the part 16 of the switch system located at the door such as mentioned earlier. This triggering of the operating signal F causes an operation of the solenoid $R_2$ such that the corresponding cam is retracted, allowing the coin to enter via the door lock channel 43 into the lock 17. At the same time the fault-announcing solenoid $R_4$ is operated such that a white marking appears in window 47. In this instance the access to the lavatory is freed and it has been ascertained that the covering of the lavatory seat has been exchanged.

If in case of a fault the clear signal B and accordingly the operating signal F are not present, the solenoid $R_1$ or its cam, respectively, is retrieved after expiration of a short time span $\Delta T$ after appearance of the switch on signal E, which time span is measured by a timer circuit 45, and accordingly the coin 25 enters into the coin return channel 42 and is returned to the user. Simultaneously the access door to the lavatory remains locked.

Conclusively, the described actuating apparatus operates to the effect, that the access to the lavatory and the collecting of the financial sum demanded therefor are allowed only if an advancing of the foil has been carried out.

The application of the apparatus according to the invention is, however, not restricted to above, it rather can specifically also be applied at freely accessible lavatories. In such case the coin receiving apparatus is preferably located at the detecting system or at the wall at the side of the lavatory. Accordingly, the IR-transmitting system can be deleted and replaced by a wire or cable, respectively, connection.

Furthermore, the triggering of the described procedures by the user can be made by a procedure different from inserting the coin, may this be that the use of the lavatory shall be free of charge or that another kind of payment, such as, for instance, magnet cards which can be cancelled are utilized. In the latter case the coin checking apparatus is replaced by a card cancelling apparatus of known design, by means of which apparatus a credit stored on the card is cancelled step by step. In such case the insertion of a suitable card will trigger the described testing operation and the cancelling will be carried out not earlier than after the presence of the clear signal B. Such an application allows at the same time to restrict the utilization of a specific lavatory to a certain group of persons, such as may be of importance, for instance, in clubhouses, hospitals, etc. In such case the card may be given merely a simple legitimatizing function.

Finally in such cases in which neither a specific legitimatization for the use of the lavatory nor the payment for the use thereof is foreseen, the release then proceeds automatically by means of light barriers, pressure sensitive floor areas, carpets etc. In such case the actuating apparatus in accordance with the invention has as object to inform in case of a malfunction the maintenance personnel or user, respectively.

Specifically by publically accessible lavatories the apparatus can be used by utilizing the electric current which is present at any rate together with an alarming system which acts upon a not authorized manipulation at the apparatus, which alarming system can be provided, depending on the chosen system of guarding, with a detector which operates upon an unauthorized manipulation, which detector may be, for instance, a sensor or an inertia switch which triggers the alarm.

Specifically an alarm sound generator can be located at the lavatory which operates in such case, when the detecting system D has detected an advancing of the foil without a simultaneous operating of the motor M. In such case an alarm signal is sounded as soon as an attempt is made to advance the hose-shaped foil 3 by a manual pulling thereof or then when this foil is otherwise manipulated.

While there are shown and described present preferred embodiments of the invention, it is to be distinctly understood that the invention is not limited thereto, but may be otherwise variously embodied and practiced within the scope of the following claims.

I claim:

1. In a means for applying a covering structure in the form of a hose-shaped foil onto a lavatory seat and including a means for storing said hose-shaped foil, a controlled means for advancing said hose-shaped foil along said lavatory seat and a means for taking up a respective spent foil section, which hose-shaped foil is arranged to be drawn off at the one end from said means for storing the hose-shaped foil by a length corresponding to the length of said lavatory seat, is arranged further to be advanced by said controlled means for advancing the foil along the lavatory seat and finally to be taken up at its other end in said spent foil take-up means, an improved actuating apparatus, the improvement comprising a drive control system operative to supervise and check an anewed covering of the lavatory seat by said hose-shaped foil upon each triggering of an advancing motion of said foil and to generate a control signal in accordance with the result of said supervision and check.

2. The improved actuating apparatus according to claim 1, in which said drive control system is connected to a detecting system and is responsive to an advancing movement of said hose-shaped foil at the area of said foil storage means upon each triggering of the advancing movement of said foil such to generate a control signal upon a detection of a foil advancing movement.

3. The improved actuating apparatus according to claim 2, in which said controlled foil advancing means is located at said spent foil take-up means.

4. The improved actuating apparatus of claim 2, in which said foil storage means comprises a free-wheeling foil dispenser roll, said foil dispenser roll having a means for triggering a signal which may be triggered in said detecting system upon a rotational movement of said dispenser roll.

5. The improved actuating apparatus of claim 4, wherein said signal is an electrical signal.

6. The improved actuating apparatus of claim 4, wherein said signal is an inductive signal.

7. The improved actuating apparatus of claim 5, wherein said signal is a capacitive signal.

8. The improved actuating apparatus of claim 5, wherein said signal is an optoelectrical signal.

9. The improved actuating apparatus of claim 4, wherein said signal is a mechanical signal.

10. The improved actuating apparatus of claim 4, in which said detecting system is arranged to detect at least one angle of rotation of said dispenser roll, which angle corresponds to the length of the operational test advancing motion of the foil such to detect a rotating motion of said dispenser roll.

11. The improved actuating apparatus according to claim 10, in which said detecting system comprises an inductive receiver and in which said dispenser roll is provided with metallic markings which are detectable by said inductive receiver in the course of said operational test advancing motion.

12. The improved actuating apparatus according to claim 1, comprising a means for an automatic triggering of the foil advancing motion or the checking thereof, respectively.

13. The improved actuating apparatus according to claim 12, in which said automatic advancing motion triggering means comprises a light barrier system.

14. The improved actuating apparatus according to claim 12, in which said automatic advancing motion triggering means comprises a sensor system.

15. The improved actuating apparatus according to claim 2 in combination with a releasing system operative to check a lavatory use condition and to cause the feeding operation of said foil, in which said releasing system is connected to the foil drive control system and to the detecting system for exchange of control signals and further triggers the drive control upon presence of said lavatory use condition.

16. The improved actuating apparatus according to claim 15, in which said releasing system is spatially separated from said foil drive and said detecting system, and in which the spatially separated systems are each provided with a transceiver operative to transmit at the one hand a releasing signal from said releasing system to said foil drive system and at the other hand a control signal from said detecting system to said releasing system.

17. The improved actuating apparatus according to claim 16, in which said releasing system comprises a coin receiving apparatus, and in which the operation of advancing said foil is triggered by means of insertion of a suitable coin and in which such coin is returnable in case of a missing control signal from said detecting system to said releasing system.

18. The improved actuating apparatus according to claim 16, in which said releasing system comprises a card reading or cancelling, respectively, apparatus, and in which the operation of advancing said foil is triggerable by means of insertion of a suitable card and a respective cancelling is not initiated in case of a missing control signal from said detecting system to said releasing system.

19. The improved actuating apparatus according to claim 15, in which said releasing system is located in the general area of said detecting system and is interconnected by means of a connecting line for the exchange of signals.

20. The improved actuating apparatus according to claim 15, comprising further an alarming device operatable at least upon an unauthorized manipulation at said releasing system.

21. The improved actuating apparatus according to claim 15 in combination with a door lock forming a lockable access to a lavatory and cooperating with said releasing system, in which said door lock is unlockable in response to the presence of the control signal received from said detecting system.

22. The improved actuating apparatus of claim 21, said releasing system including a coin receiving apparatus, in which a coin intended to trigger a release is arrestable in a standby position until presence of the releasing control signal, from which standby position said coin is either releasable for unblocking said door lock or returnable via a coin return section.

23. A dispenser roll in combination with the improved actuating apparatus according to claim 11, in which said dispenser roll comprises laterally projecting supporting stubs of which at least one is provided at least one of its face surfaces with a metallic coating.

* * * * *